United States Patent [19]

Imbeault

[11] Patent Number: 4,808,134

[45] Date of Patent: Feb. 28, 1989

[54] WATER SKI BOOT

[76] Inventor: Jacques Imbeault, 75 boulevard Des Hauts-Bois, Ste-Julie, Québec, Canada, J0L 2S0

[21] Appl. No.: 936,834

[22] Filed: Dec. 2, 1986

[51] Int. Cl.[4] ..... A63C 15/06

[52] U.S. Cl. ..... 441/70; 36/114; 36/117; 280/615; 441/72; 441/77

[58] Field of Search ..... 441/68, 72, 73, 76, 441/77, 70; 114/88, 357; 24/230.5 R, 369, 371; 280/11.31, 615, 623, 636; 224/155

[56] References Cited

U.S. PATENT DOCUMENTS

| | | | |
|---|---|---|---|
| 1,714,352 | 5/1929 | Echda | 441/77 |
| 2,362,137 | 11/1944 | Kagan | 24/371 X |
| 2,482,074 | 9/1949 | Stephens | 441/77 |
| 2,991,524 | 7/1961 | Dobrikin | 24/371 |
| 3,190,408 | 6/1965 | Petterson | 114/88 X |
| 4,487,345 | 12/1984 | Pierce et al. | 224/155 |
| 4,487,427 | 12/1984 | Salomon | 280/636 X |
| 4,562,653 | 1/1986 | Salomon | 280/615 X |

FOREIGN PATENT DOCUMENTS

| | | | |
|---|---|---|---|
| 350191 | 8/1932 | Canada . | |
| 517961 | 11/1955 | Canada . | |
| 587879 | 12/1959 | Canada . | |
| 807596 | 7/1951 | Fed. Rep. of Germany | 441/73 |
| 2376672 | 9/1978 | France | 441/77 |

*Primary Examiner*—Sherman D. Basinger
*Attorney, Agent, or Firm*—Samuel Meerkreebs

[57] ABSTRACT

A water ski boot comprising an upper and a sole. The upper includes respective toe and heel portions and the sole extends forwardly on the toe portion to provide a platform like portion extending generally to match the width of the upper. At least one elongated aperture extends laterally of the sole to terminate adjacent the marginal edges thereof. The aperture is such that it provides a sliding-gripping engagement with an elongated abutment on a water ski, whereby the boot may be detachably and operably secured to the water ski.

8 Claims, 7 Drawing Sheets

WATER SKI BOOT

BACKGROUND OF THE INVENTION (a) Field of the Invention

The present invention relates to an improved water ski, an improved water ski boot and improved anchoring means for use in aiding securement of a chair or the like to a pair of water skis. It also relates to a ski supported seat or the like.

(b) Description of the Prior Art

Major drawbacks exist in respect of the prior art devices, such include expensive construction, failure to provide positive and thus efficient securement of a water ski boot to a water ski and particularly quick and efficient release of the water ski boot from a water ski when rapid release is necessary, and failure to provide quick and resilient connect and disconnect devices for the mounting of a chair or the like on water skis. Further, to provide a water ski having good breaking qualities when in use.

Thus it is an important aim of the present invention to overcome all of the aforementioned drawbacks. It is a further important aim of the present invention to provide a novel and useful arrangement utilizing a pair of water skis.

SUMMARY OF THE INVENTION

In one aspect of the present invention there is provided, a water ski boot comprising an upper and a sole, the upper including respective toe and heel portions and the sole extending forwardly of the toe portion to provide a platform like portion extending generally to match the width of the upper, and having therein at least one elongated aperture extending laterally of the sole to terminate adjacent the marginal edges thereof, the aperture being such that it provides a sliding-gripping engagement with an elongated abutment on a water ski, whereby the boot maybe detachably and operably secured to the water ski.

In a further aspect of the present invention there is provided, a water ski boot comprising an upper and a sole, the upper including respective toe and heel portions and the sole extending forwardly of the toe portion to provide a platform like portion extending generally to match the width of the upper, and having therein apertures for sliding-gripping engagement with respective abutments on a water ski, whereby the boot may be detachably secured to the water ski, and the apertures being arranged within the platform like portion such that when the boot is in its secured position on the water ski, substantially no movement in the plane of the sole occurs.

In a still further aspect of the present invention there is provided, an anchoring means for use, for example, on a water ski to aid securement of a chair or the like to the water ski, comprising in combination, a bracket adapted for positive securement to the water ski and a hook or the like adapted for detachable securement to a portion of the chair, the hook including a shank portion interconnected to a resilient member forming an extension of the shank portion, the resilient member including means thereon for engaging and cooperating with the bracket, when it is secured in position on the ski, whereby there is provided a spring loaded hook to ensure its retention on the chair portion and to ensure its ready release therefrom.

In a still further aspect of the present invention there is provided, a water ski having elongated top, bottom and side wall surfaces terminating respectively at the front and rear ends of the ski, the improvement comprising, providing an elongated channel in the bottom surface, which channel extends lengthwise of the ski intermediate the front and rear ends, and at least one baffle in the channel, the baffle comprising a member hingedly suspended laterally of the ski whereby to substantially restrict the flow of water passing through the elongated channel when the ski is in use, the member being freely swingable about the hinge suspension between a first position whereat it lies in a plane extending normal to the length of the ski for baffling operation and a second position whereat it lies in a plane extending in common with the length of the ski for non-baffling operation, and stop means associated with the member for maintaining the member in the first position when the ski is moved through water, causing a flow of water to pass through the channel in a particular direction.

In a still further aspect of the present invention there is provided, a ski supported seat comprising in combination, a seat or the like including at least one support member therefore extending outwardly on opposite sides thereof, a pair of skis extending side by side in spaced parallel relation one to another at an elevation below the seat, and adapted to receiving engage and support the support member adjacent the opposite sides of the seat and anchoring means associated with each of the skis for use in detachably securing the seat to the skis.

BRIEF DESCRIPTION OF THE DRAWINGS

The invention is illustrated by way of example in the accompanying drawings wherein.

Figure 3:
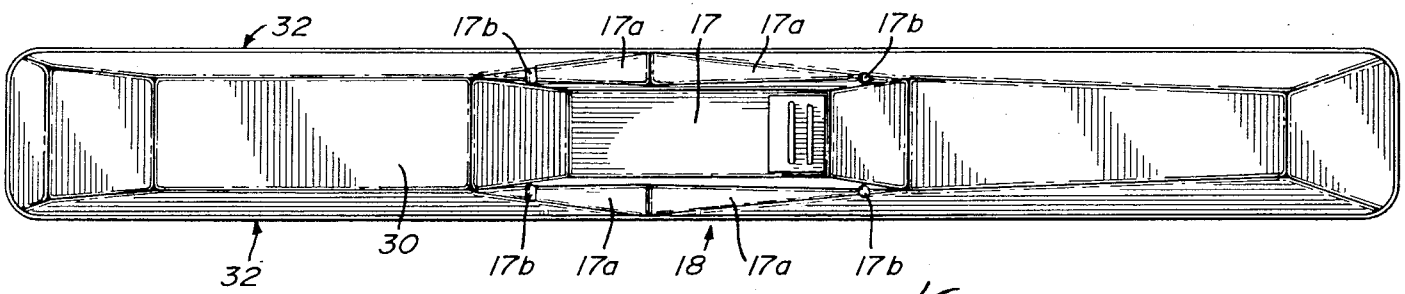
FIG. 3 is a plan view of a water ski in accordance with the present invention.
Figure 7:
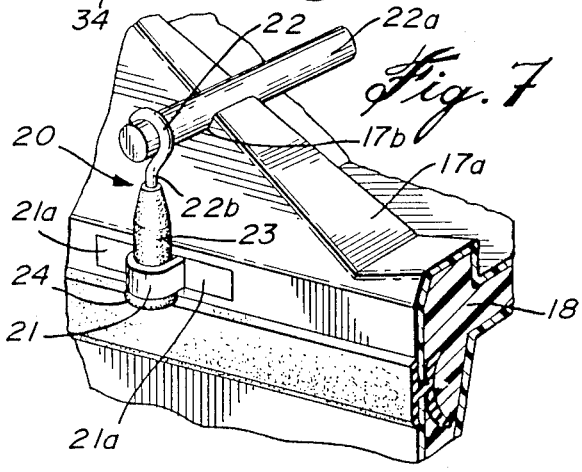
FIG. 7 is a part sectioned fragmentary view of an anchoring device in accordance with the present invention.
Figure 8:
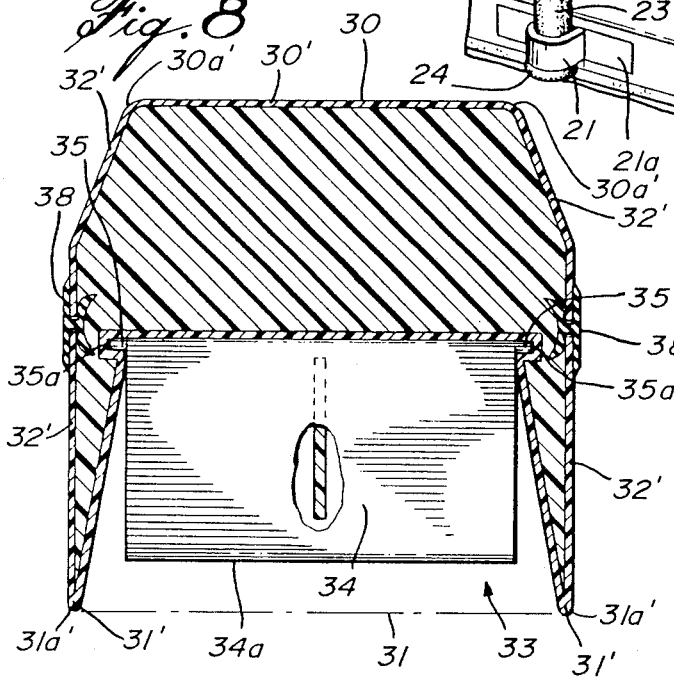
Figure 9:
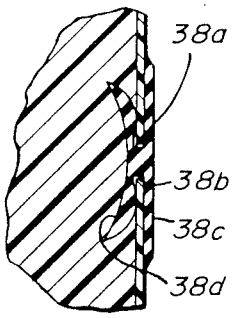
Figure 10:
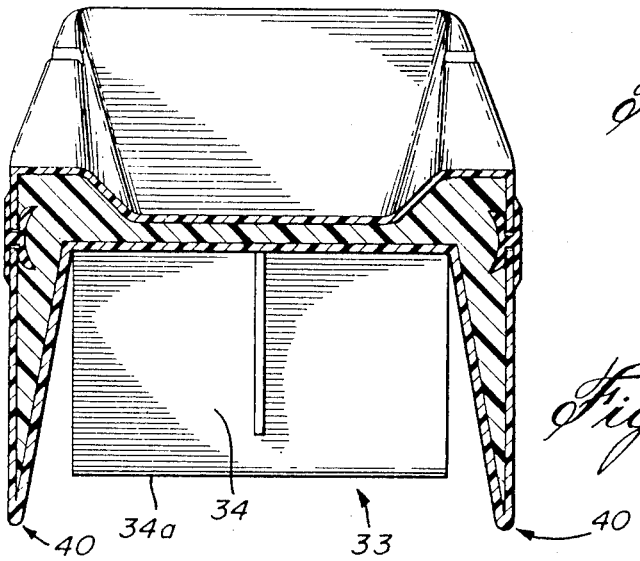
Figure 11:
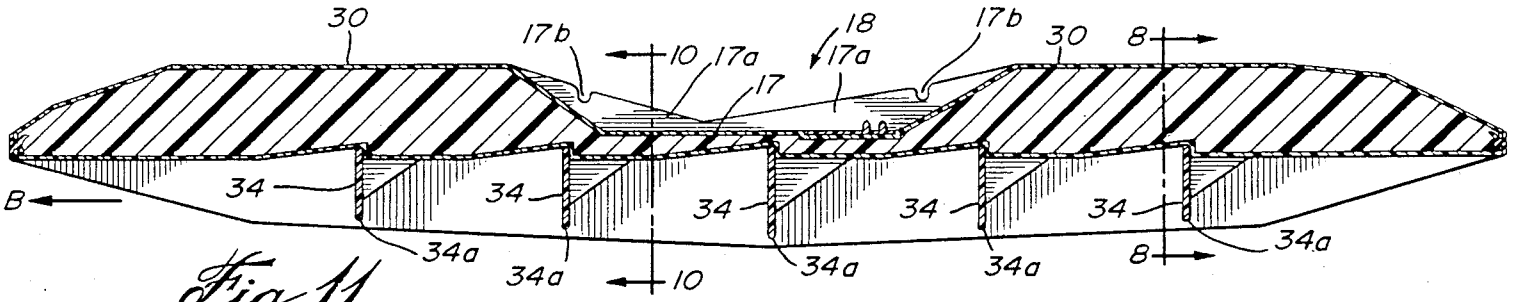
Figure 12:
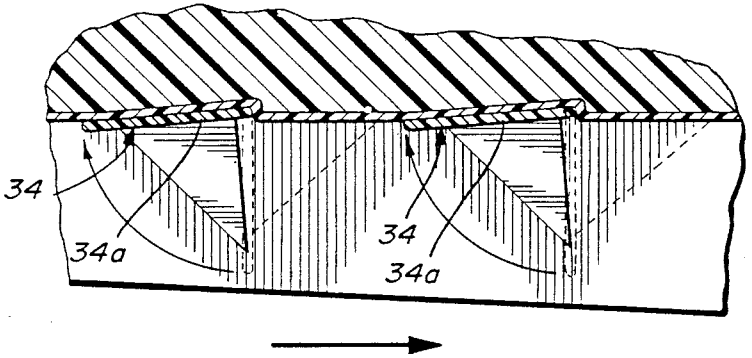
Figure 13:
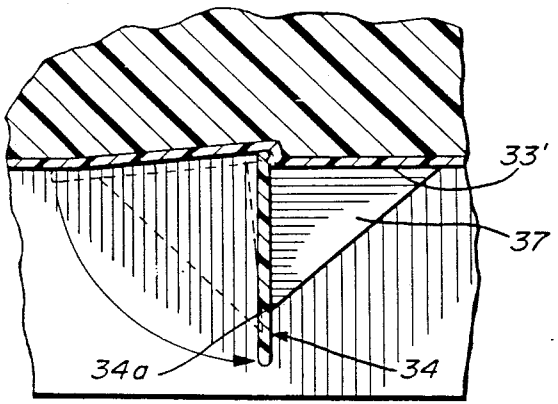
Figure 14:
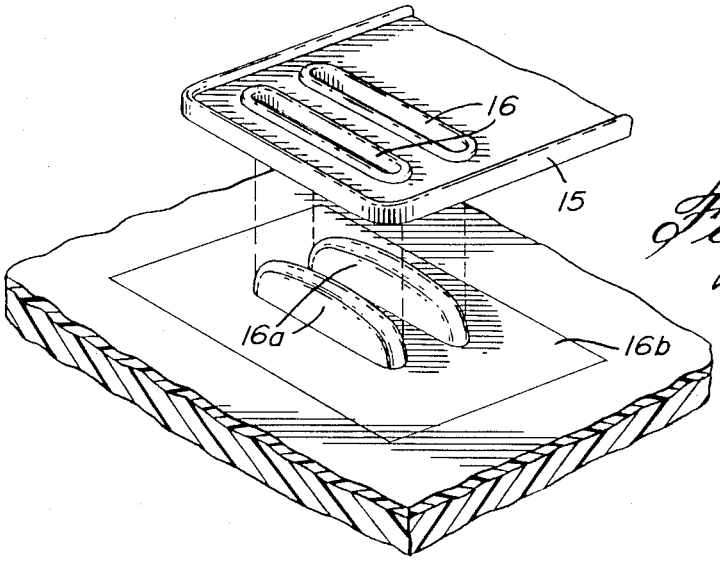
Figure 15:
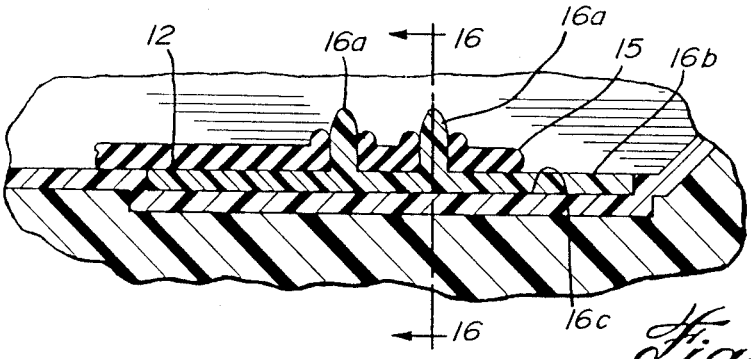
Figure 16:
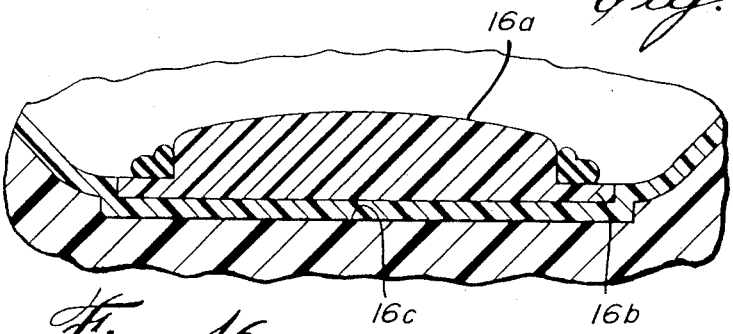

FIG. *7a* is a fragmentary view showing the anchoring device seen in FIG. 7 when applied to a further embodiment in accordance with the present invention;

FIG. 8 is a sectional view taken along line 8-8 in FIG. 11;

FIG. 9 is an enlarged view of a detail seen in FIG. 8;

FIG. 10 is a sectional view taken along line 10—10 in FIG. 11;

FIG. 11 is a sectioned side elevational view of the water ski shown in FIG. 3;

FIG. 12 is a fragmentary view to a larger scale, of details seen in FIG. 11 when in an alternative position;

FIG. 13 is a fragmentary view to a larger scale, of a detail shown in FIG. 11;

FIG. 14 is a part sectioned fragmentary view of a water ski boot sole part and associated ski part, in accordance with the present invention;

FIG. 15 is a sectioned fragmentary view of the parts shown in FIG. 14 when assembled together; and FIG. 16 is a view taken along line 16—16 in FIG. 15.

Figure 17:
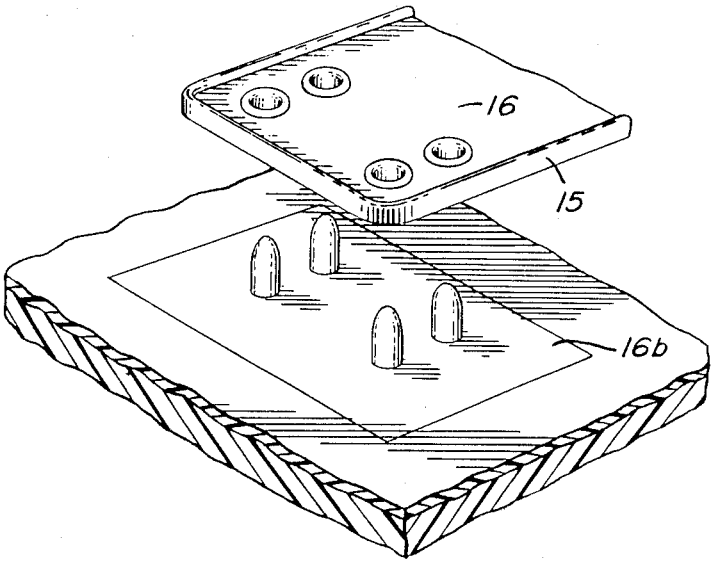

FIG. 17 is a fragmentary top plan view of another embodiment of the detail shown in FIG. 14.

DESCRIPTION OF PREFERRED EMBODIMENTS

Figure 1:
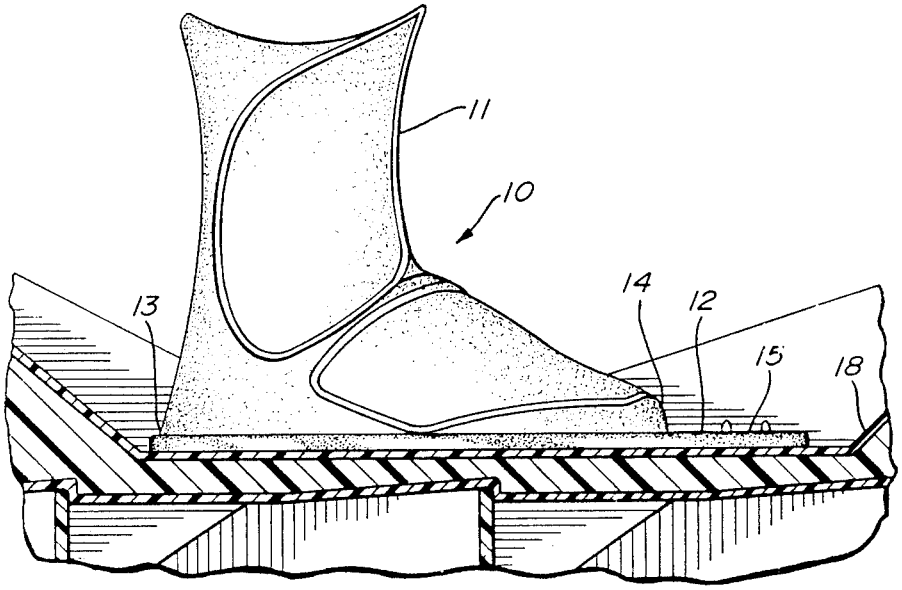
FIG. 1 is a side elevational view of a water ski boot in accordance with the present invention.

There is shown in FIG. 1 a water ski boot 10 comprising an upper 11 and sole 12, the upper including a heel portion 13 and a toe portion 14. As can be seen particularly in FIG. 2, sole 12 extends forwardly of toe portion 14 to provide a platform like portion 15 extending generally to match the width of the upper 11. Clearly seen from FIG. 2, platform portion 15 includes a pair of elongated apertures 16 best seen in FIG. 14, extending laterally of sole 12 to terminate adjacent the marginal edges thereof. Each aperture 16 includes a sliding-gripping engagement with an elongated abutment 16*a* attached to and extending up from the boot receiving surface 17 of ski 18. This arrangement affords boot 10 to be positively secured to ski 18 and yet quickly removed therefrom if necessary, thus to be detachably and operable secured to the ski 18.

To facilitate manufacture or modification to an existing ski, abutments 16*a* are formed integrally with a plate 16*b* which is received within a recess 16c, best seen in FIGS. 15 and 16. This ensures the upper surface of plate 16*b* sits flush with the recessed boot receiving surface 16*d* denoted in FIG. 14.

In alternative embodiments, particularly to facilitate modification to existing skis, plate 16*b* may be secured beside a boot receiving plate of similar thickness thus avoiding the necessity of providing a recess 16c.

Other embodiments may, if desired, comprise a single aperture 16 and abutment 16*a*. Aperture 16 and abutment 16*a* are elongated in order to provide good stability for boot 10 on ski 18, thus eliminating any tendency to relative sliding movement between boot 10 and ski 18. It is visualized that some embodiments might comprise abutments 16*a* where they vary in length one to another.

In still other embodiments according to the invention, the single elongated abutment 16*a* may be replaced by a pair of spaced circular abutments as shown in FIG. 17 which could likewise engage aperture 16 adjacent the ends thereof. Such would provide stability and prevent relative sliding between boot 10 and ski 18. Alternatively, elongated aperture 16 could be replaced by circular apertures to engage the aforementioned spaced apart circular abutments. Again, if desired, four circular apertures could replace the two elongated apertures for engagement with respectively four circular abutments, the apertures and abutments being located adjacent the marginal edges of platform 15.

Figure 2:
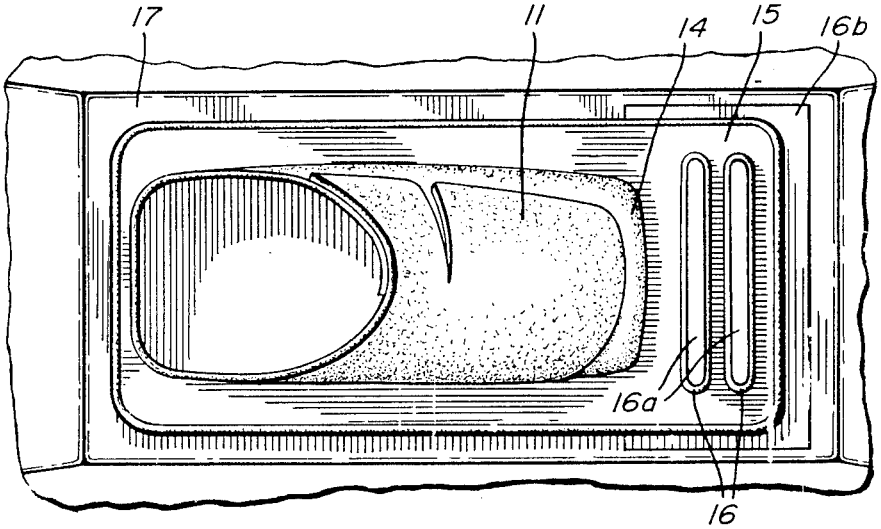
FIG. 2 is a plan view of a water ski boot in accordance with the present invention.

In the preferred embodiment shown, sole 12 is planar though it will be evident it may comprise other configurations dictated by style. Sole 12, apart from being planar, extends as seen in FIG. 2, outboard of boot 10 affording even further stability for boot 10 on ski 18. Although sole 12 is of rectangular shape in the preferred embodiment, it may of course be of a further shape dictated by style.

Boot 10 comprising upper 11 and sole 12 must be flexible and resilient and may be produced in a variety of materials including suitable plastics.

Attention is directed to FIG. 7 showing an anchoring means 20 for use on ski 18 and others (not shown) for example, for use in aiding securement of a chair A or other devices (not shown) to water ski 18.

Referring again to FIG. 7, there is seen a "U"-shaped bracket 21 adapted, by virtue of legs 21a, for positive securement to water ski 18 by any well known suitable means including plastic welding, or if desired, integrally molding the bracket with ski 18. A hook or the like 22, which could for example be substituted by an eye (not shown) is adapted, by virtue of its size, for detachable securement to portion 22*a* of chair A. Hook 22 includes a shank portion 22*b* interconnected to resilient member 23, forming an extension of shank portion 22*b*. Resilient member 23 includes therewith an abutment or shoulder 24 for cooperatively engaging bracket 21 when secured on ski 18. Thus it will be realized by virtue of resilient member 23, a spring loaded hook is provided to ensure it is retained on chair portion 22*a* and to ensure its ready release therefrom.

Figure 4:
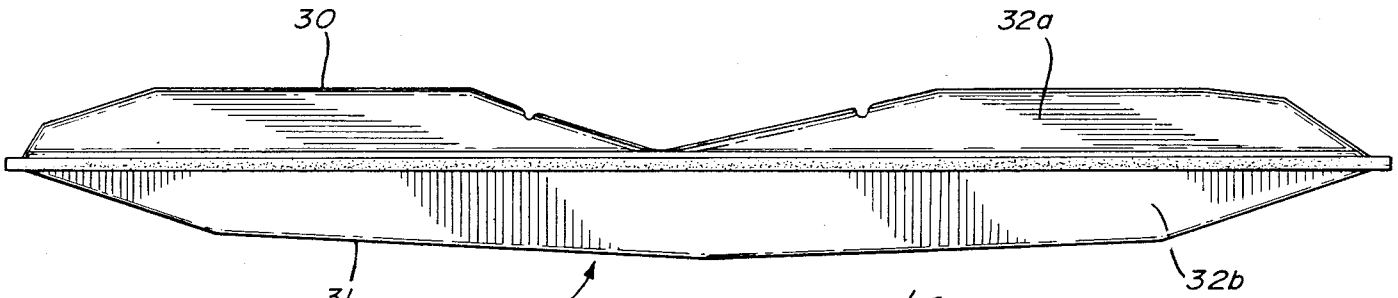
FIG. 4 is a side elevational view of the water ski shown in FIG. 3.
Figure 6:
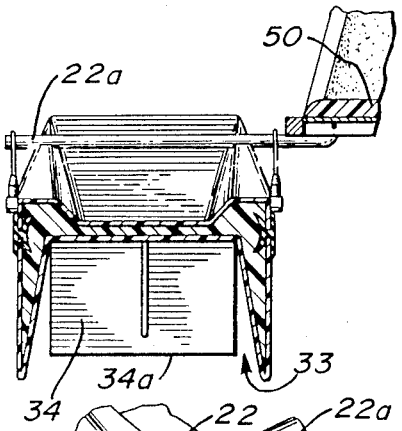
FIG. 6 is a sectional view taken along line 6—6 in FIG. 5.

Attention is now directed to FIGS. 3 and 4 showing water ski 18 having elongated top, bottom and side wall surfaces denoted respectively 30, 31 and 32 terminating respectively at the front and rear ends of the ski 18. As best seen in FIGS. 6, 9 and 10, an elongated channel 33 is provided in the bottom surface 31 and extends lengthwise of ski 18 from end to end. Channel 33, as seen from FIG. 8 for example, comprises a trapezoidal like shape. As seen from FIG. 11 for example, a series of baffles 34 are provided within channel 33. In other embodiments, it is visualized one or more baffles 34 might be employed notwithstanding the preferred embodiment employs a number of the same. Baffle 34 comprises, in the case of the preferred embodiment, a planar member 34a. Again, it is visualized that shapes other than planar might be used to obtain a similar result in operation. Planar member 34a is suspended by a hinge 35 extending laterally of ski 18, such being clearly seen in FIG. 8.

Hinge 35 is conveniently suspended within recess pockets 35*a* integral with ski 18. Baffle 34 thus restricts the flow of water passing through elongated channel when ski 18 is in use. Baffle 34, more particularly planar member 34*a*, freely swings about hinge 35 between a first fully dependent position shown, for example in FIGS. 8, 10, 11 and 13, to a fully retracted second non-baffling position, clearly seen in FIG. 12. A stop means 37 seen in FIG. 13, is provided for maintaining planar member 34*a* in its depending position when ski 18 is moved through water causing a flow of water to pass through 33 in a particular direction i.e. as indicated by arrow B in FIG. 11. Stop means 37, which comprises a triangular configuration, is secured to planar member 34*a* and swings therewith to engage channel 33 and is mounted perpendicularly to planar member 34*a* to ensure minimum obstruction in channel 33 when planar member 34*a* is retracted to its non-baffling position.

The aforedescribed novel construction results in a water ski offering substantial improvement over ones in the prior art, particularly in terms of braking efficiency. Referring to FIG. 11, during operation when braking operation is required, ski 18 is moved through the water in the direction of arrow B such that the water flow pushes against baffles 34, swinging them about their respective hinges 35 until stopped by the respective stops 37, acting against wall 33' of channel 33, as clearly seen in FIG. 13. Conversely, braking is released when water ski 18 is moved through the water in a direction opposite to that indicated by arrow B.

Referring now to further construction details of ski 18. As seen in FIG. 11, top wall surface 30 includes therein recessed boot receiving area 17 as previously mentioned, and is flanked on either side thereof by walls 17*a* having grooves 17*b* therein for use in receiving and supporting portion 22*a* of chair A, or alternatively other items similarly supported. Area 17 may include a variety of abutment designs for use with an apertured boot sole as aforedescribed. As seen in FIG. 8, top wall 30′ extends downwardly adjacent its peripheral edges 30*a*′ in a direction toward bottom wall 31′ to form the upper part of side walls 32′. Further, that bottom wall 31′ extends upwardly adjacent its peripheral edges 31*a*′ in direction toward top wall 30′ to form the lower part of side walls 32′. Side walls 32′ are joined together by a joining device 38 extending peripherally around ski 18. Device 38, which may comprise an extruded section of material, includes as seen in FIG. 9, a pair of grooves 38*a* and 38*b* formed by walls 38*c* and 38*d* and adapted to slidingly receive respective upper and lower walls 32′ therein, and grip the same to prevent removal therefrom. It will be understood, other alternative suitable types of joiners may be used in place of the particular one disclosed. As seen from FIG. 8, walls 30′, 31′ and 32′, which if desired may comprise a plastic material, together define a cavity filled with a suitable lightweight buoyant filler material, such as urethane.

Water ski 18, it will be noted from FIG. 4, has a top surface comprising a convex configuration extending on respective sides of boot receiving recess 17. Further, that the lower part of water ski 18 comprises, as clearly seen from FIG. 10, for example, a pair of parallel spaced apart, elongated, depending, wing-like members 40, affording, together with baffles 34, positive control during use of water ski 18. Water ski 18, includes the aforedescribed "U"-shaped brackets 21 positively secured thereto in the manner shown in FIG. 7, for use with the remaining parts comprising chair anchoring means 20.

Figure 5:
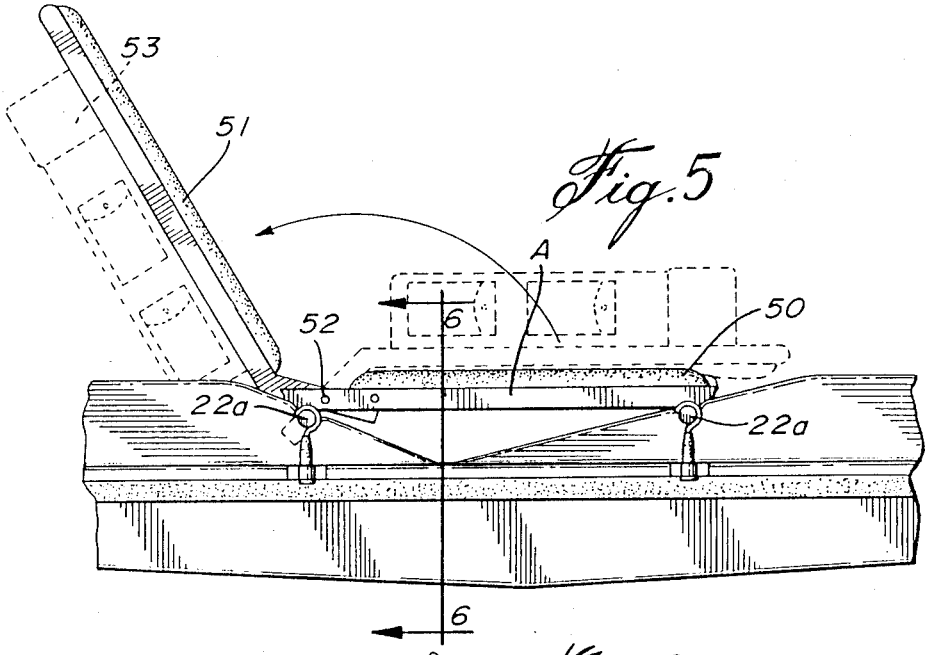
FIG. 5 is a part side elevational view of the ski shown in FIG. 4 including a seat mounted thereon.

Chair A it will be seen, comprises a cushioned seat frame 50 and cushioned backrest frame 51 foldably arranged thereon via pivot 52. Aforementioned chair portion 22*a* comprising a rod-like configuration, is rigidly secured to seat frame 50 by suitable means such as welding. As will be evident to those skilled in the art to which the present invention is directed, variations may be made in the design of the quick connect and disconnect attachment of seat frame 50 to ski 18 and which will perform a similar function to that of the arrangement shown. Backrest frame 51 may comprise strap means or the like thereon (not shown) for use in securing a backpack 53 or other equipment thereon, as shown in FIGS. 5 and 5*a*.

Figure 5A:
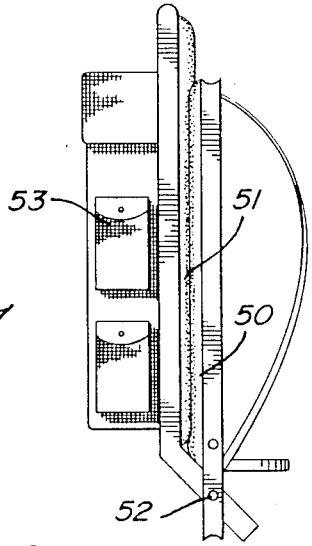
FIG. 5a is a fragmentary, side elevational view, of the seat shown in FIG. 5, in folded down position.
Figure 7A:
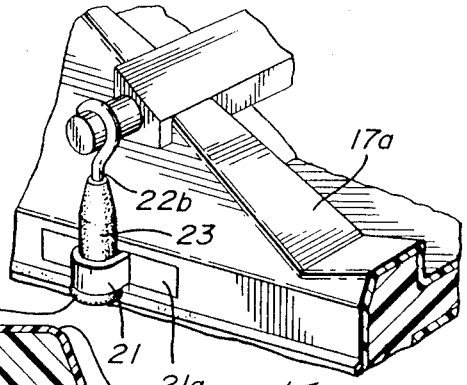

Referring to FIG. 5*a* showing backrest frame 51 in its fold down position upon cushioned seat frame 50 and showing a backpack 53 securely stored thereon by strapping (not shown). It will be realized, backrest frame 51 in its folded down position in effect provides a transport platform upon which various items may be stored, besides backpacks. Thus in the present and other embodiments a crate or closed container might be installed upon backframe 51 or form part thereof. It is visualized that alternative larger embodiments to the ones shown may be provided wherein skis 18 in fact comprise elongated pontoons of similar configuration, but of much larger dimension and seat A with cushioned frames 50 and 51 is replaced by a container type cargo platform removable attached to the larger pontoon skis by suitable means, including ones of the type shown. In a further embodiment, chair A could be supported upon a single cross member and supported within cradle cavities in the skis, as shown in FIG. 7*a*. The cross-sectional shape of the single cross member where it engages the cradle cavities, could be of rectangular shape as shown or alternatively of hexagonal or other suitable shape, whereby to prevent turning of the member in the cavity and accordingly of the chair relative to the skis. In a still further embodiment, the skis could be snow skis. Further, the anchoring means could be, if desired, applied to the seat portion of the chair A.

From the foregoing, it will be seen a novel and useful arrangement is provided utilizing a pair of water skis or others, such stemming from adapting of a pair of skis whereby to support a chair or the like, including means affording quick assembly and disassembly of the same.

We claim:

1. A water ski boot to be used with a water ski, the boot comprising an upper and a sole, said upper completely enclosing a foot and including a toe portion and a heel portion, the sole including a forward portion projecting beyond the toe portion of the upper, and releasable binding means comprising a forward portion of the sole defining aperture means comprising at least one aperture having an axis which extends laterally of the boot, the forward portion of the sole being flexible and resilient to provide a sliding-gripping engagement of the aperture means with corresponding anchor projections on the water ski such that only the material of the forward portion of the sole defining the aperture means engages the anchor projections to releasably secure the boot to the water ski whereby the boot is released and separated from the ski due to separation of the sole from the anchor projections.

2. A water ski boot as defined in claim 1, wherein the aperture means is in the form of an elongated slot, the axis of which extends laterally and the anchor projection on the ski is in the form of an upstanding rib having an axis which extends laterally of the ski.

3. A water ski boot as defined in claim 2, wherein a further elongated aperture is provided in said forward sole portion and extends in spaced parallel relation to said one elongated aperture, said further elongated aperture also being adapted for sliding-gripping engagement with a further elongated anchor projection on said water ski.

4. A water ski boot as defined in claim 3, wherein said further elongated aperture extends in common length with said one aperture.

5. A water ski boot as defined in claim 2, wherein said sole extends to define, with forward sole portion, a marginal edge completely surrounding said upper.

6. A water ski boot as defined in claim 1, wherein there are at least a pair of apertures in the forward portion of the sole, the pair of apertures are aligned with said lateral axis, and a pair of corresponding anchor projections are provided on the ski adapted to receive said pair of apertures in a slidinggripping manner.

7. A water ski boot as defined in claim 6, wherein there are two pairs of apertures and corresponding pairs of anchor projections on the ski, the respective pairs of apertures being in parallel lateral axes.

8. A water ski boot as defined in claim 1, wherein the sole and forward portion of the sole form a rectangular flexible platform of greater dimensions than the periphery of the upper.

* * * * *